US009845517B2

(12) United States Patent
Mori et al.

(10) Patent No.: US 9,845,517 B2
(45) Date of Patent: Dec. 19, 2017

(54) SUB-ZERO TREATMENT DEVICE

(71) Applicant: TAIYO NIPPON SANSO CORPORATION, Tokyo (JP)

(72) Inventors: Kosuke Mori, Kai (JP); Masahiro Yonekura, Kai (JP); Hidetoshi Ohta, Kofu (JP)

(73) Assignee: TAIYO NIPPON SANSO CORPORATION, Tokyo (JP)

( * ) Notice: Subject to any disclaimer, the term of this patent is extended or adjusted under 35 U.S.C. 154(b) by 204 days.

(21) Appl. No.: 14/777,074

(22) PCT Filed: Mar. 12, 2014

(86) PCT No.: PCT/JP2014/056503
§ 371 (c)(1),
(2) Date: Sep. 15, 2015

(87) PCT Pub. No.: WO2014/148335
PCT Pub. Date: Sep. 25, 2014

(65) Prior Publication Data

US 2016/0024606 A1 Jan. 28, 2016

(30) Foreign Application Priority Data

Mar. 22, 2013 (JP) ..... 2013-060698

(51) Int. Cl.
*F28F 7/00* (2006.01)
*C21D 1/62* (2006.01)
(Continued)

(52) U.S. Cl.
CPC ..... *C21D 1/62* (2013.01); *C21D 1/613* (2013.01); *F25D 3/10* (2013.01); *C21D 1/64* (2013.01)

(58) Field of Classification Search
CPC ..... F25D 3/10; F25D 17/005; F25D 17/08; F25D 17/04; A47F 3/04; F24F 2001/0092;
(Continued)

(56) References Cited

U.S. PATENT DOCUMENTS 1,429,435 A * 9/1922 Jones ..... F25D 17/005 165/108
4,078,394 A * 3/1978 Chamberlain ..... F25D 3/11 62/203
(Continued)

FOREIGN PATENT DOCUMENTS

CN 201411478 2/2010
CN 102378891 3/2012
(Continued)

OTHER PUBLICATIONS

Japanese Office Action issued App. No. 2013-060698 dated Jan. 5, 2016 (w/ translation).
(Continued)

*Primary Examiner* — Justin Jonaitis
(74) *Attorney, Agent, or Firm* — Nixon & Vanderhye P.C.

(57) ABSTRACT

The present invention provides a sub-zero treatment device capable of uniformly cooling a cooling target object and reducing the amount of liquid refrigerant used for cooling the cooling target object. The sub-zero treatment device has an exhaust member extending from a through-hole provided in a cooling tank constituting a cooling target object mounting chamber through to the interior of the cooling target object mounting chamber, and having an exhaust port, wherein the exhaust port is disposed in an exhaust port positioning space, which is the space located in the upper half of the cooling target object mounting chamber and having a width in the transverse direction that is equal to the
(Continued)

maximum width in the transverse direction of the suction port.

7 Claims, 8 Drawing Sheets

(51) Int. Cl.
*F25D 3/10* (2006.01)
*C21D 1/613* (2006.01)
*C21D 1/64* (2006.01)

(58) Field of Classification Search
CPC ..... F24F 2006/143; F24F 2006/146; F24F 5/0035; F24F 6/02; F24F 6/12; F24F 6/14; F24F 6/16; F24F 6/18; F24F 13/00; F24F 1/0007; F25L 1/18; H01L 23/4735
USPC ..... 165/185; 62/304, 309, 314, 404, 405, 62/426, 440
See application file for complete search history.

(56) References Cited

U.S. PATENT DOCUMENTS 4,103,768 A * 8/1978 Persson ..... B65G 17/063 198/778
4,459,825 A * 7/1984 Crouch ..... A01N 1/02 62/404
4,612,780 A * 9/1986 Briley ..... A23L 3/361 62/303
4,741,168 A 5/1988 Boyer et al.
4,768,535 A * 9/1988 Marx ..... B08B 7/0092 134/169 R
5,186,008 A * 2/1993 Appolonia ..... A23L 3/363 62/266
5,205,135 A * 4/1993 Lang ..... A23L 3/361 62/381
5,398,521 A * 3/1995 Baron ..... B65G 21/18 62/381

FOREIGN PATENT DOCUMENTS

| | | |
|---|---|---|
| JP | 62-77770 U | 5/1987 |
| JP | 63-500053 | 1/1988 |
| JP | 63-45006 | 2/1988 |
| JP | 6-273025 | 9/1994 |
| JP | 08-035785 | 2/1996 |
| JP | 10-060524 | 3/1998 |
| JP | 10-311641 | 11/1998 |
| JP | 11-83218 | 3/1999 |
| JP | 2000-014721 | 1/2000 |
| JP | 2003-14356 | 1/2003 |
| JP | 2005-113166 | 4/2005 |
| JP | 2007-032907 | 2/2007 |
| JP | 2007-511728 | 5/2007 |
| JP | 3946796 | 7/2007 |
| JP | 2009-8372 | 1/2009 |
| JP | 2009-533641 | 9/2009 |
| WO | WO 2005/051089 | 6/2005 |
| WO | WO 2007/116383 | 10/2007 |

OTHER PUBLICATIONS

Chinese Office Action issued in App. No. 201480016293.0 dated Jun. 28, 2016 (w/ partial translation).
Japanese Notice of Allowance issued in App. No. 2013-060698 dated Jul. 12, 2016 (w/ translation).
International Search Report for PCT/JP2014/056503 dated Jun. 3, 2014, five (5) pages.

* cited by examiner

PRIOR ART

SUB-ZERO TREATMENT DEVICE

TECHNICAL FIELD

The present invention relates to a sub-zero treatment device capable of cooling a steel material such as a machine component to a low temperature of 0° C. or lower, thereby improving the performance such as the hardness and the toughness of the steel material.

This application is the U.S. national phase of International Application No. PCT/JP2014/056503 filed Mar. 12, 2014 which designated the U.S. and claims priority to Japanese Patent Application No. 2013-060698, filed Mar. 22, 2013, the entire contents of each of which are hereby incorporated by reference.

BACKGROUND ART

Sub-zero treatments in which steel materials such as machine components are cooled to low temperatures of 0° C. or lower are used conventionally to improve the performance such as the hardness and the toughness of the steel materials.

One known sub-zero treatment method is a low-temperature atmospheric method in which the atmosphere inside a cooling tank housing a cooling target object is cooled using a refrigerator or liquid nitrogen or the like, thereby cooling the cooling target object.

Patent Document 1 discloses a sub-zero treatment device (see FIG. 12) used in performing the above sub-zero treatment.

FIG. 12 is a cross-sectional view illustrating a schematic outline of a conventional sub-zero treatment device.

As illustrated in FIG. 12, a sub-zero treatment device 100 disclosed in Patent Document 1 has a cooling tank 102, a refrigerant inlet passage 103, a liquid refrigerant inlet valve 104, a temperature controller 105, an agitation fan 108, and a baffle plate 109.

The cooling tank 102 is formed from an insulating material, and has an internal treatment space. An exhaust port 102A is provided in a side wall of the cooling tank 102, and penetrates through the side wall. When the pressure inside the cooling tank 102 increases due to evaporation of the liquid nitrogen (the liquid refrigerant), the exhaust port 102A externally exhausts a portion of the nitrogen gas from inside the cooling tank 102 to a location outside the cooling tank 102 in order to ensure that the pressure is maintained within a prescribed pressure range.

The refrigerant inlet passage 103 is connected to a liquid nitrogen supply source not shown in the drawing. When the liquid refrigerant inlet valve 104 (the valve provided in the refrigerant inlet passage 103) is opened, the refrigerant inlet passage 103 supplies liquid nitrogen into the cooling tank 102.

The temperature controller 105 measures the temperature inside the cooling tank 102, and adjusts the degree of opening of the liquid refrigerant inlet valve 104 based on the result of the measurements.

The agitation fan 108 is housed inside the cooling tank 102. The agitation fan 108 converts the liquid nitrogen to a mist and diffuses the mist through the interior of the cooling tank 102, as well as agitating the low-temperature nitrogen gas (low-temperature gas) inside the cooling tank 102.

The baffle plate 109 is housed inside the cooling tank 102, and is disposed between the agitation fan 108 and the cooling target object 101. The baffle plate 109 has a suction port and blowout ports. The baffle plate 109 has the function of enhancing the agitation action of the agitation fan 108.

PRIOR ART LITERATURE

Patent Documents

Patent Document 1: Japanese Patent (Granted) Publication No. 3,946,796

DISCLOSURE OF INVENTION

Problems to be Solved by the Invention

However, when the low-temperature nitrogen gas is discharged externally from the cooling tank 102 through the exhaust port 102A that penetrates through a side wall of the cooling tank 102, as is the case in the sub-zero treatment device 100 disclosed in Patent Document 1, temperature irregularities tend to occur inside the cooling tank 102.

If temperature irregularities occur inside the cooling tank 102 in this manner, then the cooling of the cooling target object 101 tends to lack uniformity, and fluctuations occur in the quality of the cooling target object 101.

Further, depending on the position in which the exhaust port 102A is provided within the side wall of the cooling tank 102, the low-temperature nitrogen gas may be exhausted through the exhaust port 102A before contributing satisfactorily to the cooling of the treatment space, and therefore a large amount of the liquid refrigerant is required for cooling the cooling target object 101.

Accordingly, the present invention has an object of providing a sub-zero treatment device that is capable of uniformly cooling a cooling target object and reducing the amount of liquid refrigerant used for cooling the cooling target object.

Means for Solving the Problems

In order to achieve the above object, the present invention provides:

(1) a sub-zero treatment device containing: a cooling tank composed of a cooling tank main body formed from a base plate and first to fourth side walls, and a lid, the cooling tank having a cooling target object mounting chamber in which a cooling target object is mounted, and a fan housing chamber that is connected to the cooling target object mounting chamber; a baffle member, disposed inside the cooling tank so as to separate the cooling target object mounting chamber and the fan housing chamber, and having a suction port for guiding the atmosphere of the cooling target object mounting chamber into the fan housing chamber, and blowout ports for guiding the atmosphere of the fan housing chamber into the cooling target object mounting chamber; an agitation fan housed in the fan housing chamber in a position opposing the suction port, the agitation fan converting a liquid refrigerant supplied to the fan housing chamber into a mist or a low-temperature gas, as well as agitating the atmosphere inside the cooling tank; and an exhaust member, extending from a through-hole provided in the cooling tank main body through to the interior of the cooling target object mounting chamber, and having an exhaust port; wherein the first to fourth side walls are disposed so as to surround the outer peripheral edge of the base plate and contact the lid, thereby forming an internal space inside the cooling tank, the exhaust port is disposed in an exhaust port positioning space located in the cooling target object mounting chamber within the internal space, such that if the orthogonal height between the surface of the base plate on the side of the internal space and the surface of the lid on the side of the internal space is deemed H, then the exhaust port positioning space is a space composed of a portion reaching an orthogonal distance of H/2 from the surface of the lid on the side of the internal space, and a transverse width of the exhaust port positioning space, which is the width in a direction orthogonal to the aforementioned height and parallel to the baffle member having the suction port, is equal to the maximum value for the transverse width of the suction port in a direction orthogonal to the aforementioned height and parallel to the baffle member having the suction port, with the center of the transverse width of the exhaust port positioning space coinciding with the center of the transverse width of the suction port.

Further, the present invention also provides:

(2) the sub-zero treatment device disclosed in (1), wherein the exhaust port is disposed in the exhaust port positioning space located between the cooling target object and the baffle member.

Furthermore, the present invention also provides:

(3) the sub-zero treatment device disclosed in (1) or (2), wherein the exhaust member has an exhaust member main body, and the exhaust member main body is positioned so that the exhaust port faces toward the lid.

Moreover, the present invention also provides:

(4) the sub-zero treatment device disclosed in (3), wherein the exhaust member main body is a circular cylindrically shaped pipe, and when the exhaust member is cut along a surface that passes through the exhaust port in a direction orthogonal to the direction of extension of the exhaust member main body, the exhaust port has a central angle, formed by connecting the two edges of the exhaust port with the center of the exhaust member main body, that is not more than 90°.

Further, the present invention also provides:

(5) the sub-zero treatment device disclosed in (1), wherein the exhaust member has a water drain hole that is formed facing toward the base plate.

Furthermore, the present invention also provides:

(6) the sub-zero treatment device disclosed in any one of (1) to (5), wherein the baffle member has at least one plate-like member having a uniform thickness, and the suction port and the blowout ports penetrate through the same plate-like member.

Moreover, the present invention also provides:

(7) the sub-zero treatment device disclosed in any one of (1) to (5), wherein the baffle member has a first plate-like member that faces the agitation fan, and second and third plate-like members disposed orthogonally relative to the first plate-like member, the suction port penetrates through the first plate-like member, and the blowout ports penetrate through the second and third plate-like members.

Effects of the Invention

In the sub-zero treatment device of the present invention, by providing an exhaust member which has an exhaust port and extends from a through-hole provided in the cooling tank that forms the cooling target object mounting chamber through to the interior of the cooling target object mounting chamber, and positioning the exhaust port in an exhaust port positioning space, which is the space located in the upper half of the cooling target object mounting chamber and having a width in the transverse direction that is equal to the maximum value for the width in the transverse direction of the suction port, temperature fluctuations in the atmosphere inside the cooling target object mounting chamber can be suppressed even when a low-temperature gas (the gasified liquid refrigerant) is discharged through the exhaust port to a location outside the cooling tank.

As a result, the cooling target object can be cooled uniformly (or in other words, fluctuations in the quality of the cooling target object can be suppressed).

Further, because exhausting of the low-temperature gas through the exhaust port before the gas can contribute satisfactorily to the cooling of the treatment space can be suppressed, the amount of the liquid refrigerant used in cooling the cooling target object can be reduced.

In other words, the sub-zero treatment device of the present invention is capable of uniformly cooling a cooling target object and reducing the amount of liquid refrigerant used for cooling the cooling target object.

BEST MODE FOR CARRYING OUT THE INVENTION

Embodiments of the present invention are described below in detail with reference to the drawings. The drawings used in the following description are provided to assist the description of the structures of the embodiments of the present invention, but the size, thickness, and dimensions and the like of the various illustrated components may differ from the dimensional relationships found in the actual sub-zero treatment devices.

First Embodiment

Figure 1:
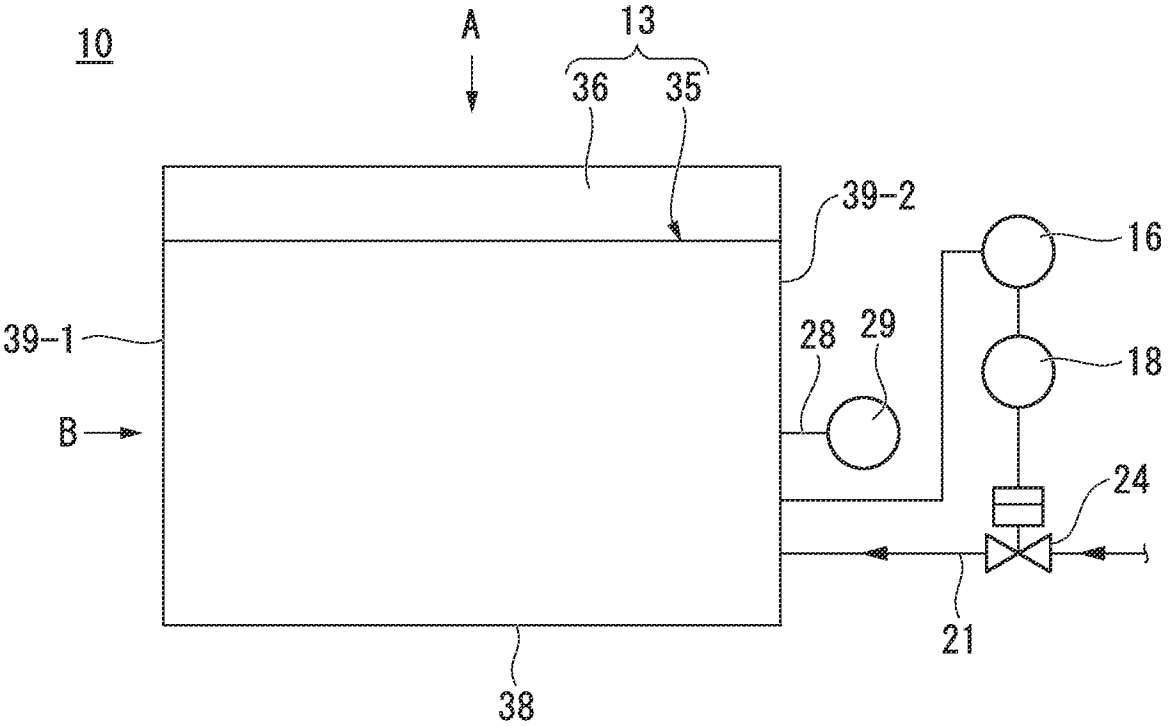
FIG. 1 is a side view illustrating the external appearance of a sub-zero treatment device according to a first embodiment of the present invention.
Figure 2:
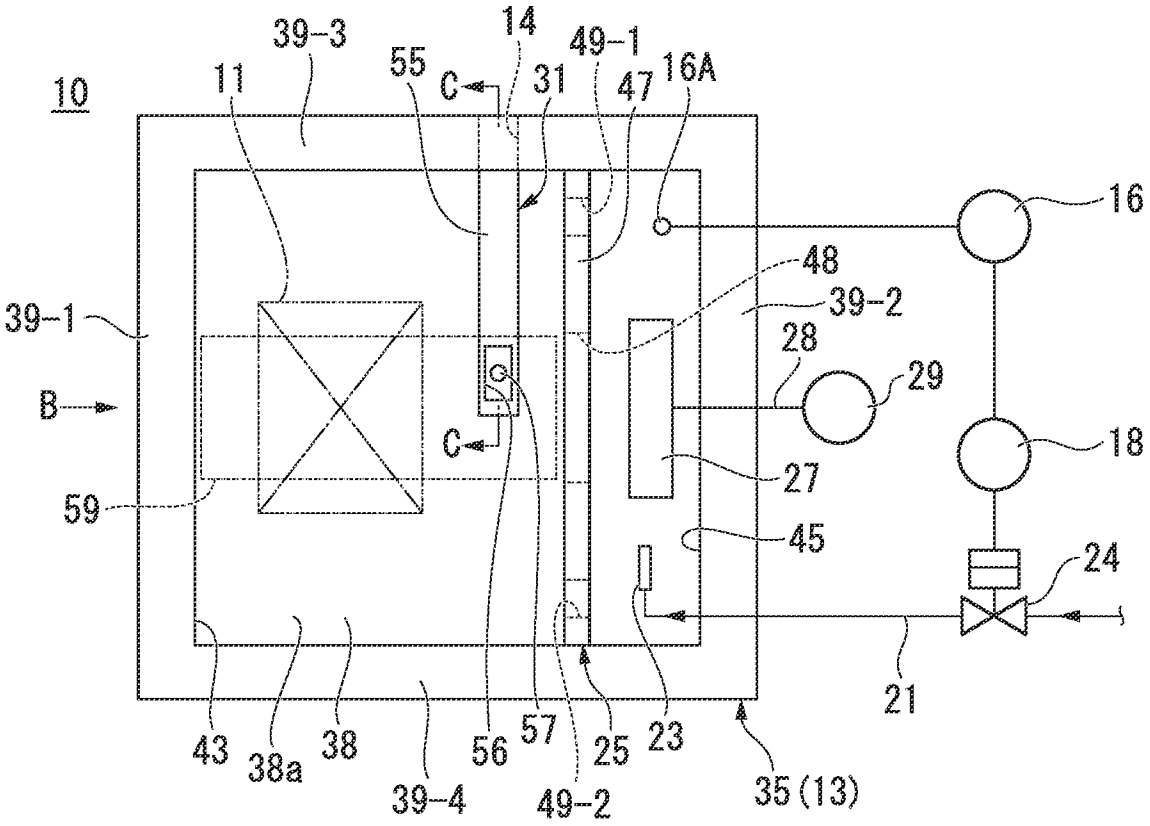
FIG. 2 is a diagram for explaining the structural components of the sub-zero treatment device housed inside the cooling tank main body illustrated in FIG. 1, and is a plan view of the cooling tank illustrated in FIG. 1 viewed through the lid illustrated in FIG. 1 along the direction A.

FIG. 1 is a side view illustrating the external appearance of a sub-zero treatment device according to a first embodiment of the present invention. FIG. 2 is a diagram for explaining the structural components of the sub-zero treatment device housed inside the cooling tank main body illustrated in FIG. 1, and is a plan view of the cooling tank illustrated in FIG. 1 viewed through the lid illustrated in FIG. 1 along the direction A.

Accordingly, the lid 36 that is one of the structural components of the sub-zero treatment device 10 of the first embodiment is omitted in FIG. 2.

Figure 3:
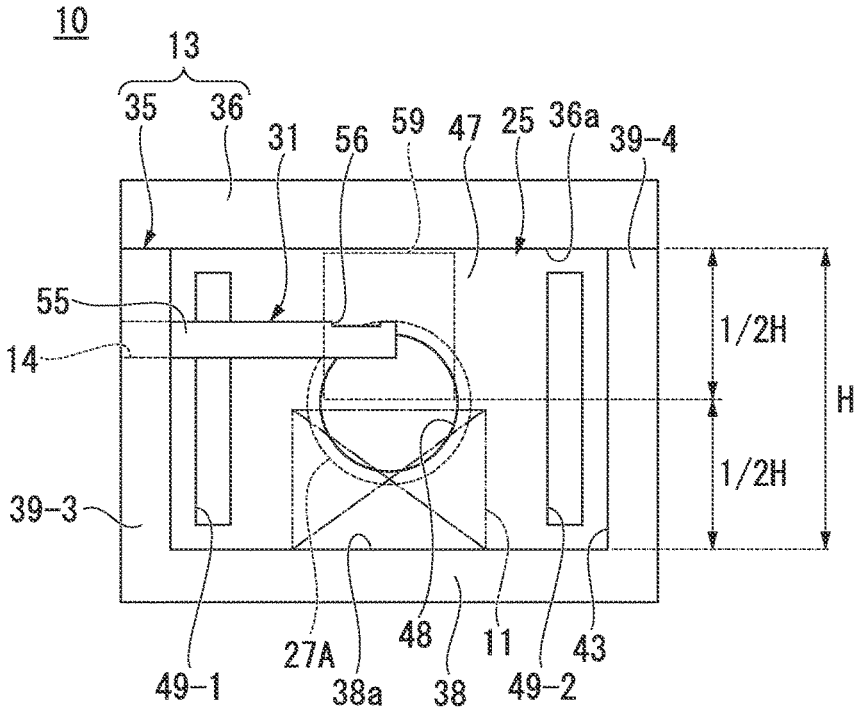
FIG. 3 is a diagram for explaining the structural components of the sub-zero treatment device housed inside the cooling tank main body illustrated in FIG. 1, and is a diagram of the inside of the cooling tank illustrated in FIG. 1 viewed through the first side wall illustrated in FIG. 1 along the direction B.

FIG. 3 is a diagram for explaining the structural components of the sub-zero treatment device housed inside the cooling tank main body illustrated in FIG. 1, and is a diagram of the inside of the cooling tank illustrated in FIG. 1 viewed through the first side wall illustrated in FIG. 1 along the direction B. Accordingly, the first side wall 39-1 that is one of the structural components of the sub-zero treatment device 10 of the first embodiment is omitted in FIG. 3.

Further, structural portions that are the same in FIG. 1 to FIG. 3 are labeled with the same reference signs.

As illustrated in FIG. 1 to FIG. 3, the sub-zero treatment device 10 of the first embodiment includes a cooling tank 13, a through-hole 14, a temperature sensor 16, a temperature controller 18, a refrigerant supply line 21, a refrigerant supply portion 23, a liquid refrigerant inlet valve 24, a baffle member 25, an agitation fan 27, a rotational axis 28, a rotational drive device 29, and an exhaust member 31.

The cooling tank 13 has a cooling tank main body 35 and the lid 36. The cooling tank main body 35 has a base plate 38 and first to fourth side walls 39-1 to 39-4.

The first to fourth side walls 39-1 to 39-4 are positioned so as to surround the outer peripheral edges of the rectangular base plate 38. The bottom edges of the first to fourth side walls 39-1 to 39-4 are integrated with the base plate 38.

The first and second side walls 39-1 and 39-2 are positioned facing each other. Similarly, the third and fourth side walls 39-3 and 39-4 are positioned facing each other.

The first and second side walls 39-1 and 39-2 are integrated with the adjacent third and fourth side walls 39-3 and 39-4.

The lid 36 contacts the top edges of the first to fourth side walls 39-1 to 39-4. As a result, a rectangular cuboid-shaped or cubic internal space (a space including a cooling target object mounting chamber 43 and a fan housing chamber 45) is formed inside the cooling tank 13.

The cooling tank 13 includes the cooling target object mounting chamber 43 and the fan housing chamber 45. The cooling target object mounting chamber 43 and the fan housing chamber 45 are separated by the baffle member 25. A cooling target object 11 is mounted inside the cooling target object mounting chamber 43.

The through-hole 14 is provided so as to penetrate through the third side wall 39-3. The through-hole 14 is positioned within a space on the third side wall 39-3 that is located in the upper half of the height H of the cooling target object mounting chamber 43, and positioned between the cooling target object 11 and the baffle member 25. The shape of the through-hole 14 may, for example, be a circular cylindrical shape (see FIG. 4 and FIG. 5), but the present invention is not limited to any particular shape. For example, a quadrangular prism-shaped through-hole 14 may also be used.

The height H refers to the distance along the orthogonal between the surface of the base plate on the side of the internal space (namely, the upper surface) and the surface of the lid on the side of the internal space (namely, the lower surface), and the space located in the upper half of the height H of the cooling target object mounting chamber 43 refers to the space, within the internal space inside the cooling tank, from the lower surface of the lid down to an orthogonal distance of H/2 below the lower surface.

The temperature sensor 16 is disposed with a tip section 16A positioned inside the fan housing chamber 45. The temperature sensor 16 is connected electrically to the temperature controller 18. The temperature sensor 16 transmits data relating to the temperature of the fan housing chamber 45 to the temperature controller 18.

A thermocouple or the like can be used as the temperature sensor 16. In such a case, the tip section 16A is the hot junction point.

The temperature controller 18 is provided outside the cooling tank 13. The temperature controller 18 is connected electrically to the temperature sensor 16 and the liquid refrigerant inlet valve 24. Data relating to the prescribed temperature range for the fan housing chamber 45 (for example, −80° C. to −70° C.) is stored in advance in the temperature controller 18.

Based on the data relating to the prescribed temperature range for the fan housing chamber 45 (for example, −80° C. to −70° C.), and the data transmitted from the temperature sensor 16 (specifically, the data relating to the actual measured temperature of the fan housing chamber 45), the temperature controller 18 adjusts the degree of opening of the liquid refrigerant inlet valve 24 (including the states of fully open and fully closed) to ensure that the temperature of the fan housing chamber 45 falls within the prescribed temperature range.

One end of the refrigerant supply line 21 is connected to a liquid refrigerant supply source (not shown in the drawings) disposed outside the cooling tank 13, and the other end is connected to the refrigerant supply portion 23 disposed inside the fan housing chamber 45. An example of the liquid refrigerant supply source (not shown in the drawings) is a source which supplies liquid nitrogen as the liquid refrigerant.

The refrigerant supply portion 23 is positioned inside the fan housing chamber 45. The refrigerant supply portion 23 is used for supplying the liquid refrigerant that has been transported through the refrigerant supply line 21 to the side surface of the agitation fan 27.

The liquid refrigerant inlet valve 24 is a solenoid valve, and is provided in the refrigerant supply line 21. The liquid refrigerant inlet valve 24 is connected electrically to the temperature controller 18.

The liquid refrigerant inlet valve 24 is used for controlling whether or not the liquid refrigerant is supplied to the refrigerant supply portion 23, and adjusting the supply rate of the liquid refrigerant supplied to the refrigerant supply portion 23.

The liquid refrigerant inlet valve 24 supplies the liquid refrigerant to the inside of the fan housing chamber 45 when the temperature inside the fan housing chamber 45 rises and breaches the prescribed temperature range (for example, −80° C. to −70° C.).

The baffle member 25 is disposed inside the cooling tank 13 so as to separate the cooling target object mounting chamber 43 and the fan housing chamber 45.

The baffle member 25 has a plate-like member 47, a suction port 48, and first and second blowout ports 49-1 and 49-2. The plate-like member 47 is a member of uniform thickness.

The top edge of the plate-like member 47 contacts the lower surface 36*a* of the lid 36 (namely, the surface on the side of the internal space), and the bottom edge of the plate-like member 47 contacts the upper surface 38*a* of the base plate 38 (namely, the surface on the side of the internal space).

Further, one edge of the plate-like member 47 in the transverse direction contacts the inside surface of the third side wall 39-3, and the other edge of the plate-like member 47 in the transverse direction contacts the inside surface of the fourth side wall 39-4.

The suction port 48 is provided so as to penetrate through a portion of the plate-like member 47 (specifically, the central portion of the plate-like member 47) opposing the agitation fan 27 housed inside the fan housing chamber 45.

In other words, the suction port 48 and the first and second blowout ports 49-1 and 49-2 are provided within the same plate-like member 47 of uniform thickness.

It is particularly preferable that the suction port 48 and the first and second blowout ports 49-1 and 49-2 are formed so that the surface area of each opening does not decrease through the interior of the plate-like member 47, but is rather a constant surface area through the entire thickness direction of the plate-like member 47.

The suction port 48 is a through-hole that is used for guiding the atmosphere of the cooling target object mounting chamber 43 toward the fan housing chamber 45.

The shape of the suction port 48 may, for example, be a similar shape to the outer shape 27A of the agitation fan 27. The size of the suction port 48 is set to substantially the same size as the outer shape 27A of the agitation fan 27.

In the present invention, the expression that the size of the suction port 48 is substantially the same as the outer shape 27A of the agitation fan 27 means that the diameter of the suction port 48 is within a range from 0.9 to 1.1 times the diameter of the agitation fan 27.

The first blowout port 49-1 penetrates through a portion of the plate-like member 47 located between the suction port 48 and the third side wall 39-3. The first blowout port 49-1 can be formed, for example, as a through-slot (slit) that extends in a direction from the base plate 38 toward the lid 36.

The second blowout port 49-2 penetrates through a portion of the plate-like member 47 located between the suction port 48 and the fourth side wall 39-4. The second blowout port 49-2 is formed with the same shape as the first blowout port 49-1. If the side wall 39-3 is deemed the right side and the side wall 39-4 is deemed the left side, then the baffle member 25 is formed with a shape having left-right symmetry.

The first and second blowout ports 49-1 and 49-2 are used for guiding the atmosphere inside the fan housing chamber 45 toward the cooling target object mounting chamber 43.

In the example shown in FIG. 3, the first and second blowout ports 49-1 and 49-2 are illustrated as through-slots that extend along the vertical direction of the plate-like member 47, but the shape of the first and second blowout ports 49-1 and 49-2 and the number of blowout ports are not limited to this particular example. Further, the shapes of the first and second blowout ports 49-1 and 49-2 may also be different from each other.

For example, a line or a plurality of lines of circular or rectangular through-hole portions may be provided in the plate-like member 47 as the first and second blowout ports 49-1 and 49-2, and the sizes of those through-hole portions may differ.

Alternatively, rectangular or oval-shaped through-slots may be positioned along either the transverse direction or the longitudinal direction of the plate-like member 47, and the sizes of those through-slots may differ.

The agitation fan 27 is disposed inside the fan housing chamber 45, in a location opposing the suction port 48. The agitation fan 27 is connected to one end of a rotational axis that penetrates through the second side wall 39-2. As a result, the agitation fan 27 is located inside the fan housing chamber 45 in a rotatable state. A sirocco fan or the like may be used as the agitation fan 27.

The agitation fan 27 converts the liquid refrigerant supplied from the side of the agitation fan 27 into a mist or a low-temperature gas, and also agitates the atmosphere inside the cooling tank 13.

As a result, the atmosphere of the cooling target object mounting chamber 43 sucked through the suction port 48 disperses to the sides behind the agitation fan 27, and the atmosphere of the fan housing chamber 45 is fed into the cooling target object mounting chamber 43 through the first and second blowout ports 49-1 and 49-2.

The rotational axis 28 penetrates through the second side wall 39-2. One end of the rotational axis 28 is connected to the agitation fan 27, and the other end, which is located outside the cooling tank 13, is connected to the rotational drive device 29.

The rotational drive device 29 is provided outside the cooling tank 13. The rotational drive device 29 rotates the agitation fan 27 via the rotational axis 28. A motor or the like can be used as the rotational drive device 29.

Figure 4:
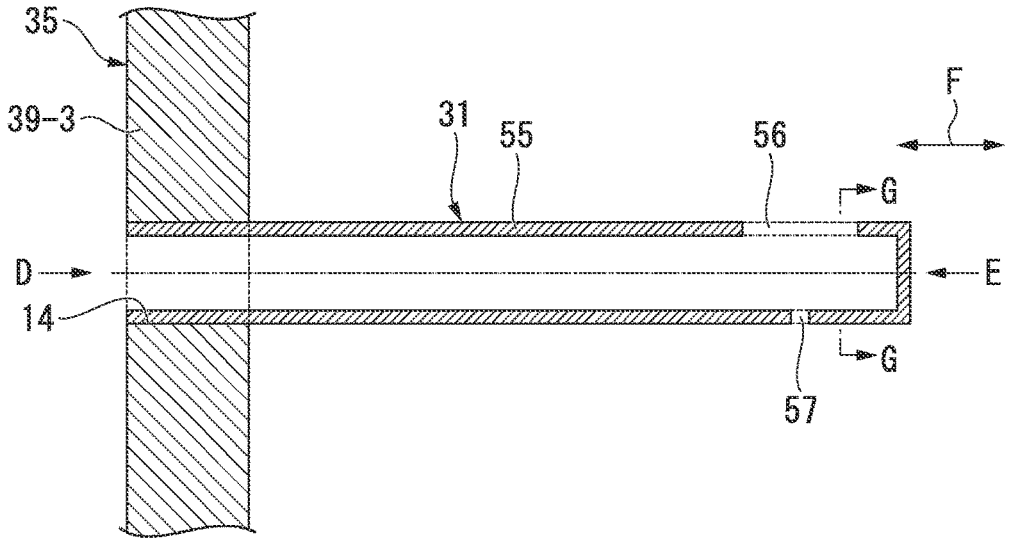
FIG. 4 is a cross-sectional view along the line C-C of the exhaust member and the third side wall of the cooling tank main body illustrated in FIG. 2.
Figure 5:
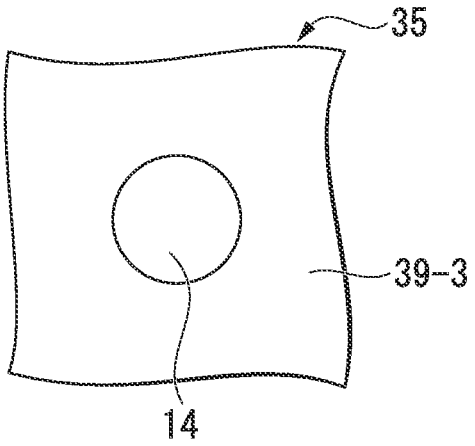
FIG. 5 is a diagram of the through-hole illustrated in FIG. 4 and the third side wall located around the periphery of the through-hole, viewed along the direction D in FIG. 4.
Figure 6:
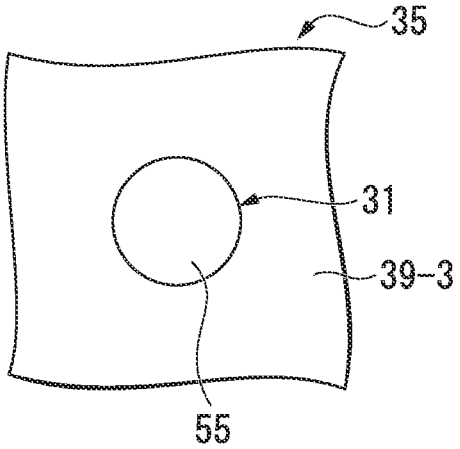
FIG. 6 is a diagram of the exhaust member illustrated in FIG. 4, viewed along the direction E in FIG. 4.

FIG. 4 is a cross-sectional view along the line C-C of the exhaust member and the third side wall of the cooling tank main body illustrated in FIG. 2. FIG. 5 is a diagram of the through-hole illustrated in FIG. 4 and the third side wall located around the periphery of the through-hole, viewed along the direction D in FIG. 4. FIG. 6 is a diagram of the exhaust member illustrated in FIG. 4, viewed along the direction E in FIG. 4. In FIG. 5, the exhaust member illustrated in FIG. 4 is omitted.

As illustrated in FIG. 2 to FIG. 4 and FIG. 6, the exhaust member 31 has an exhaust member main body 55, an exhaust port 56 and a water drain hole 57.

The exhaust member main body 55 is a cylindrical member, one end of which is open. The open end of the exhaust member main body 55 is inserted in the through-hole 14 provided in the third side wall 39-3. The outer diameter of the exhaust member main body 55 is the same as the inner diameter of the through-hole 14.

In the state where the exhaust member main body 55 is inserted in the through-hole 14, the exhaust member main body 55 extends from the through-hole 14 into the interior of the cooling target object mounting chamber 43, with the other end of the exhaust member main body 55 positioned in an exhaust port positioning space 59.

The exhaust port positioning space 59 is a space located in the upper half of the cooling target object mounting chamber 43, and is a space having a width in the transverse direction that is equal to the maximum width in the transverse direction of the suction port 48 (the diameter of the suction port 48 in the case shown in FIG. 3).

If the distance in an orthogonal direction between the lower surface 36*a* of the lid 36 and the upper surface 38*a* of the base plate 38 is deemed the height H of the cooling target object mounting chamber 43, then the aforementioned space located in the upper half is defined as the space, within the internal space inside the cooling tank, from the lower surface 36*a* of the lid 36 down to an orthogonal distance of H/2 below the lower surface. Further, the transverse direction of the exhaust port positioning space 59 and the transverse direction of the suction port 48 refer to the direction orthogonal to the aforementioned height and parallel to the baffle member 25.

Furthermore, the expression that the exhaust port positioning space 59 has a width in the transverse direction that is equal to the maximum width in the transverse direction of the suction port 48 (the diameter of the suction port 48 in the case shown in FIG. 3) means that, within the internal space inside the cooling tank, the center of the transverse width of the exhaust port positioning space coincides with the center of the maximum transverse width of the suction port, and that these widths in the transverse direction are equal.

There are no particular limitations on the outer shape of the surface of the exhaust member main body 55 orthogonal to the direction of extension, and the shape may be circular or rectangular or the like. FIG. 6 illustrates one example in which the exhaust member main body 55 is a pipe having a circular cylindrical shape (in which the outer shape of the exhaust member main body 55 is circular).

FIG. 4 describes one particular example in which the exhaust member main body 55 is inserted into the through-hole 14, but the inner diameter of the exhaust member main body 55 and the inner diameter of the through-hole 14 may be set to the same size, and the exhaust member main body 55 then secured to the cooling tank 13 without inserting a portion of the exhaust member main body 55 into the through-hole 14.

When the liquid refrigerant is supplied to the fan housing chamber 45 and the pressure inside the cooling tank 13 increases, the exhaust port 56 has a function of adjusting the pressure inside the cooling tank 13 so that it satisfies a prescribed pressure range by discharging a portion of the low-temperature gas (the gasified liquid refrigerant) through the exhaust member main body 55 to a location outside the cooling tank 13.

The exhaust port 56 is provided at the opposite end of the exhaust member main body 55 from the end that is connected to the through-hole 14. As a result, the exhaust port 56 is positioned inside the cooling target object mounting chamber 45 in a location distant from the first to fourth side walls 39-1 to 39-4 of the cooling tank 13.

In this manner, by positioning the exhaust port 56 in the exhaust port positioning space 59, which is the space located in the upper half of the cooling target object mounting chamber 43 having a width in the transverse direction that is equal to the maximum width in the transverse direction of the suction port 48 (the diameter of the suction port 48 in the case shown in FIG. 3), a low-temperature gas flow is generated along the centerline inside the cooling target object mounting chamber 43 flowing from the side wall 39-1 toward the side wall 39-2, and by positioning the exhaust port 56 within this flow, drift is eliminated and the cooling target object can be cooled uniformly (or in other words, fluctuations in the quality of the cooling target object 11 can be suppressed).

Further, the low-temperature gas located near the first side wall 39-1, the third side wall 39-3 and the fourth side wall 39-4, which does not contribute significantly to the cooling of the cooling target object mounting chamber 43, can be prevented from being discharged from the exhaust port 56, and therefore the amount of liquid refrigerant used for cooling the cooling target object 11 can be reduced.

In other words, the cooling target object 11 can be cooled uniformly, and the amount of liquid refrigerant used for cooling the cooling target object 11 can be reduced.

The exhaust port 56 is preferably disposed so that the entire exhaust port 56 is located inside the exhaust port positioning space 59, but similar effects can be achieved even when only a portion of the exhaust port 56 is located inside the exhaust port positioning space 59.

Further, if the exhaust port 56 is disposed in a space located in the lower half of the cooling target object mounting chamber 43 (namely, the space within the internal space inside the cooling tank from the upper surface 38*a* of the base plate 38 to an orthogonal distance of H/2 above the upper surface), then low-temperature gas that is still capable of satisfactorily contributing to the cooling of the cooling target object mounting chamber 43 is recovered, and therefore, as described above, it is necessary that the exhaust port 56 is disposed in the space located in the upper half of the cooling target object mounting chamber 43.

The exhaust member main body 55 has the exhaust port 56 provided in the opposite end from the end connected to the through-hole 14, with the opening of the exhaust port 56 facing the lid. By providing the exhaust port 56 facing the lid, the low-temperature gas of lower temperature that has sunk to the bottom of the cooling tank 13 must flow around the exhaust member main body 55 to reach the exhaust port 56, meaning the cold energy can be used effectively without wastage. For example, if the exhaust port 56 in the exhaust member main body 55 were to open toward the side wall 39-1 of the cooling tank, then low-temperature gas fed into the cooling tank in the horizontal direction could be readily suctioned through the exhaust port 56 prior to circulation within the cooling tank 13, resulting in cold energy wastage.

Figure 7:
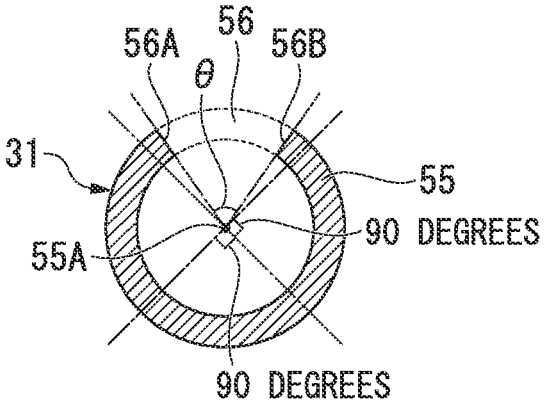
FIG. 7 is a cross-sectional view along the line G-G of the exhaust member illustrated in FIG. 4.

As illustrated in FIG. 7, when the exhaust member 31 is cut along a surface that passes through the exhaust port 56 in a direction orthogonal to the direction of extension of the exhaust member main body 55, the exhaust port 56 preferably has a central angle θ, formed by connecting the two edges 56A and 56B of the exhaust port 56 with the center of the exhaust member main body 55, that is not more than 90°. This enables the amount of the low-temperature gas suctioned through the exhaust port 56 to be set appropriately, meaning the cold energy of the low-temperature gas can be used with minimal waste.

As illustrated in FIG. 2 and FIG. 4, the water drain hole 57 penetrates through the exhaust member main body 55, and is located on the opposite side from the exhaust port 56, namely on the side facing the base plate 38 of the cooling tank 13.

When the temperature inside the cooling tank 13 reaches a temperature within the prescribed temperature range, and the supply of the liquid refrigerant is stopped, the atmosphere outside the cooling tank 13 can enter via the exhaust member main body 55 (or in other words, the exhaust member 31), and sometimes the moisture within the external atmosphere condenses and freezes inside the exhaust member main body 55, blocking the inside of the exhaust member main body 55.

Accordingly, by providing the water drain hole 57 in the exhaust member main body 55 in a position beneath the exhaust port 56, the accumulation of moisture inside the exhaust member main body 55 can be suppressed, meaning blockages inside the exhaust member main body 55 (or in other words, the exhaust member 31) can also be suppressed.

In the sub-zero treatment device of the first embodiment, by providing the exhaust member 31, which includes the exhaust port 56 and extends into the interior of the cooling target object mounting chamber 43 from the through-hole 14 provided in the third side wall 39-3 constituting the cooling target object mounting chamber 43, and positioning the exhaust port 56 within the exhaust port positioning space 59, which is the space located in the upper half of the cooling target object mounting chamber 43 having a width in the transverse direction that is equal to the maximum width in the transverse direction of the suction port 48 (the diameter of the suction port 48 in the case shown in FIG. 3), temperature fluctuations in the atmosphere inside the cooling target object mounting chamber 43 can be suppressed even when low-temperature gas (low-temperature gas not contributing to the cooling of the cooling target object mounting chamber 43) is discharged through the exhaust port 56.

As a result, the cooling target object 11 can be cooled uniformly (or in other words, fluctuations in the quality of the cooling target object 11 can be suppressed).

Further, because exhausting of the low-temperature gas through the exhaust port 56 before the gas can contribute satisfactorily to the cooling of the cooling target object mounting chamber 43 can be suppressed, the amount of the liquid refrigerant used in cooling the cooling target object 11 can be reduced.

In other words, the sub-zero treatment device 10 of the first embodiment is capable of uniformly cooling the cooling target object 11 and reducing the amount of liquid refrigerant used for cooling the cooling target object 11.

The first embodiment was described using an example in which the through-hole 14 was provided in the third side wall 39-3, but the through-hole 14 may be provided anywhere in the cooling tank 13 that constitutes the cooling target object mounting chamber 43, provided that the exhaust port 56 can be positioned in the exhaust port positioning space located between the cooling target object 11 and the baffle member 25.

Specifically, the through-hole 14 may also be provided in any one of the first side wall 39-1, the fourth side wall 39-4 and the lid 36 instead of the third side wall 39-3.

Figure 8:
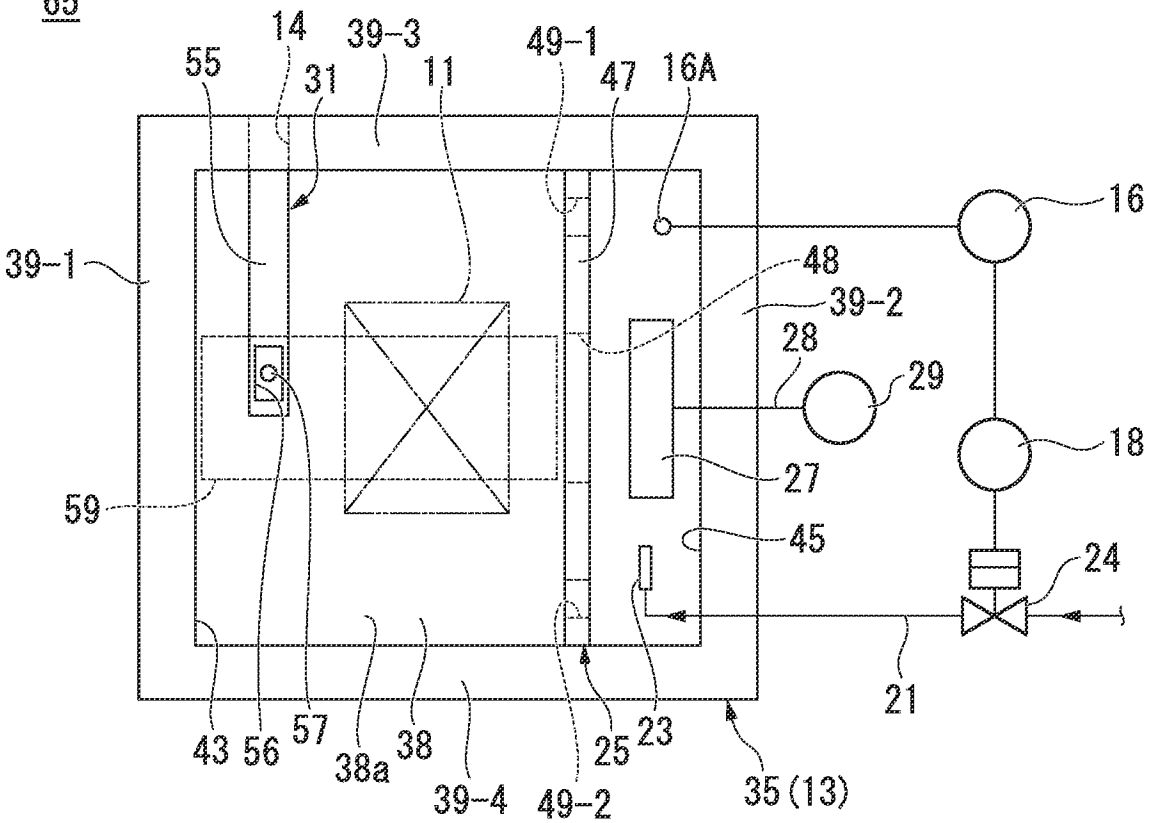
FIG. 8 is a diagram for explaining a sub-zero treatment device according to a modification of the first embodiment, and is a plan view of the sub-zero treatment device viewed through the lid of the sub-zero treatment device.

FIG. 8 is a diagram for explaining a sub-zero treatment device according to a modification of the first embodiment, and is a plan view of the sub-zero treatment device viewed through the lid of the sub-zero treatment device.

In FIG. 8, those structural portions that are the same as the sub-zero treatment device 10 of the first embodiment illustrated in FIG. 2 are labeled with the same reference signs. Further, in FIG. 8, for the sake of convenience, the lid of the sub-zero treatment device according to this modification of the first embodiment (namely, the lid 36 illustrated in FIG. 1) is omitted.

As illustrated in FIG. 8, with the exception of having different installation positions for the through-hole 14 and the exhaust member 31, the sub-zero treatment device 65 according to this modification of the first embodiment has the same structure as the sub-zero treatment device 10 of the first embodiment.

In the sub-zero treatment device 65 according to this modification of the first embodiment, the through-hole 14 is provided in the third side wall 39-3 in a position close to the first side wall 39-1, so that the exhaust port 56 is disposed within the exhaust port positioning space 59 in a position between the cooling target object 11 and the first side wall 39-1.

The sub-zero treatment device 65 according to this modification of the first embodiment, having the type of structure described above, is able to achieve similar effects to the sub-zero treatment device 10 of the first embodiment.

Second Embodiment

Figure 9:
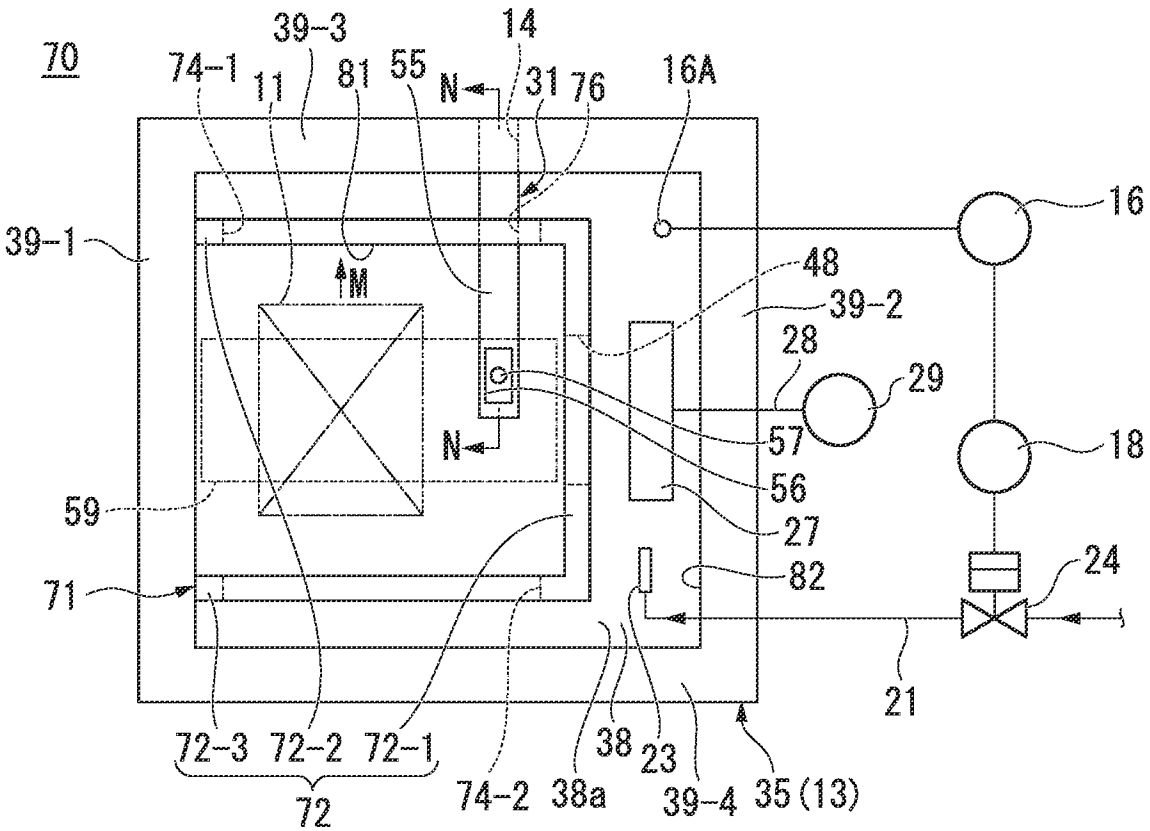
FIG. 9 is a diagram for explaining a sub-zero treatment device according to a second embodiment, and is a plan view of the sub-zero treatment device viewed through the lid of the sub-zero treatment device.

FIG. 9 is a diagram for explaining a sub-zero treatment device according to a second embodiment, and is a plan view of the sub-zero treatment device viewed through the lid of the sub-zero treatment device.

In FIG. 9, those structural portions that are the same as the sub-zero treatment device 10 of the first embodiment illustrated in FIG. 2 are labeled with the same reference signs. Further, in FIG. 9, for the sake of convenience, the lid of the sub-zero treatment device 70 according to the second embodiment (namely, the lid 36 illustrated in FIG. 1) is omitted.

As illustrated in FIG. 9, with the exception of replacing the baffle member 25 that constitutes part of the sub-zero treatment device 10 of the first embodiment, and the cooling target object mounting chamber 43 and fan housing chamber 45 separated by the baffle member 25 with a baffle member 71, and a cooling target object mounting chamber 81 and fan housing chamber 82 separated by the baffle member 71 respectively, the sub-zero treatment device 70 according to the second embodiment has the same structure as the sub-zero treatment device 10.

The baffle member 71 has an angular U-shape when viewed in plan view. The bottom edge of the baffle member 71 contacts the upper surface 38*a* of the base plate 38, and the upper edge contacts the lower surface of the lid, which is not shown in the drawing.

As a result, the baffle member 71 separates the inside of the cooling tank 13 into the cooling target object mounting chamber 81, which is located inside the baffle member 71 and has a rectangular cuboid shape, and the fan housing chamber 82, which is located outside the baffle member 71 and has a shape that appears as an angular U-shape when viewed in plan view.

The baffle member 71 has a first plate-like member 72-1, a second plate-like member 72-2, and a third plate-like member 72-3.

The first plate-like member 72-1 is disposed between the agitation fan 27 and the exhaust member 31.

The first plate-like member 72-1 is positioned parallel to the first side wall 39-1. The first plate-like member 72-1 includes the suction port 48 that opposes the agitation fan 27.

Figure 10:
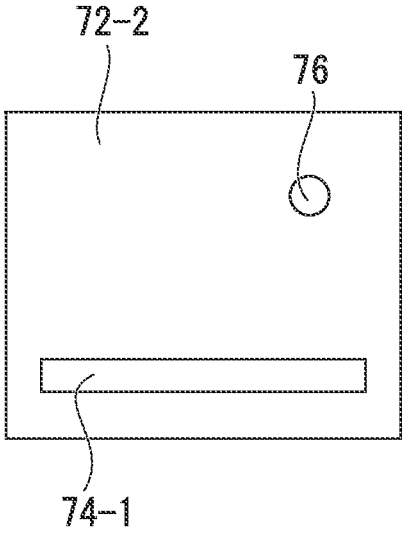
FIG. 10 is a diagram illustrating the second plate-like member of the baffle member illustrated in FIG. 9, viewed along the direction M in FIG. 9.

FIG. 10 is a diagram illustrating the second plate-like member of the baffle member illustrated in FIG. 9, viewed along the direction M in FIG. 9.

As illustrated in FIG. 9 and FIG. 10, the second plate-like member 72-2 is disposed inside the cooling tank 13 near the third side wall 39-3, in an orientation parallel to the third side wall 39-3. One of the edges in the transverse direction of the second plate-like member 72-2 is integrated with the first plate-like member 72-1, and the other edge in the transverse direction contacts the inside surface of the first side wall 39-1.

The second plate-like member 72-2 has a first blowout port 74-1 and an exhaust member insertion hole 76. The first blowout port 74-1 is provided so as to penetrate through the lower portion of the second plate-like member 72-2. The first blowout port 74-1 has the function of guiding the atmosphere of the fan housing chamber 82 into the cooling target object mounting chamber 81.

Figure 11:
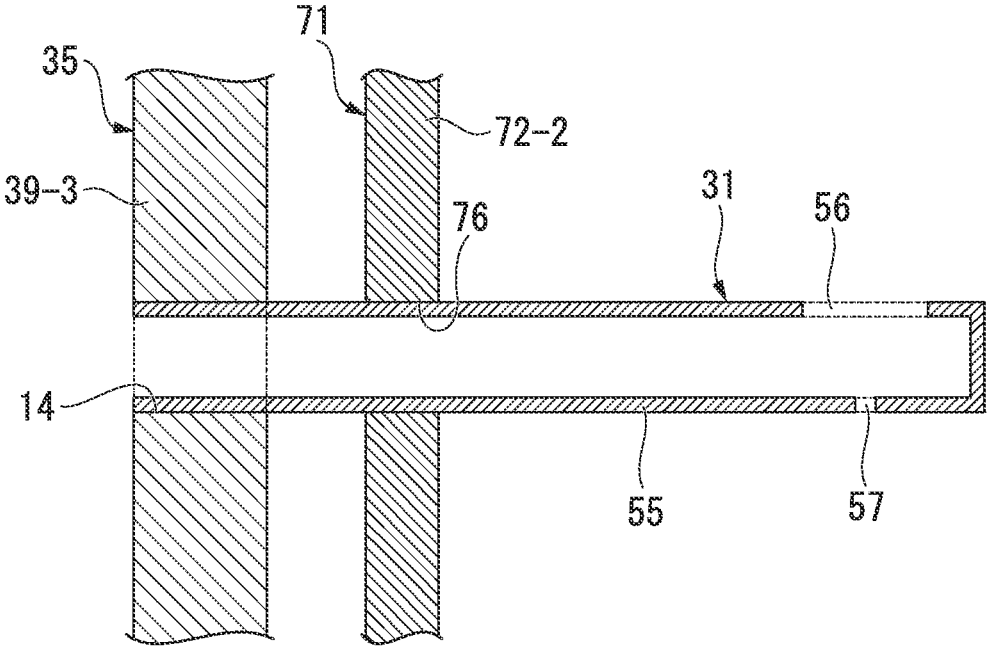
FIG. 11 is a cross-sectional view along the line N-N of the exhaust member, the third side wall of the cooling tank main body, and the second plate-like member of the baffle member illustrated in FIG. 9.
Figure 12:
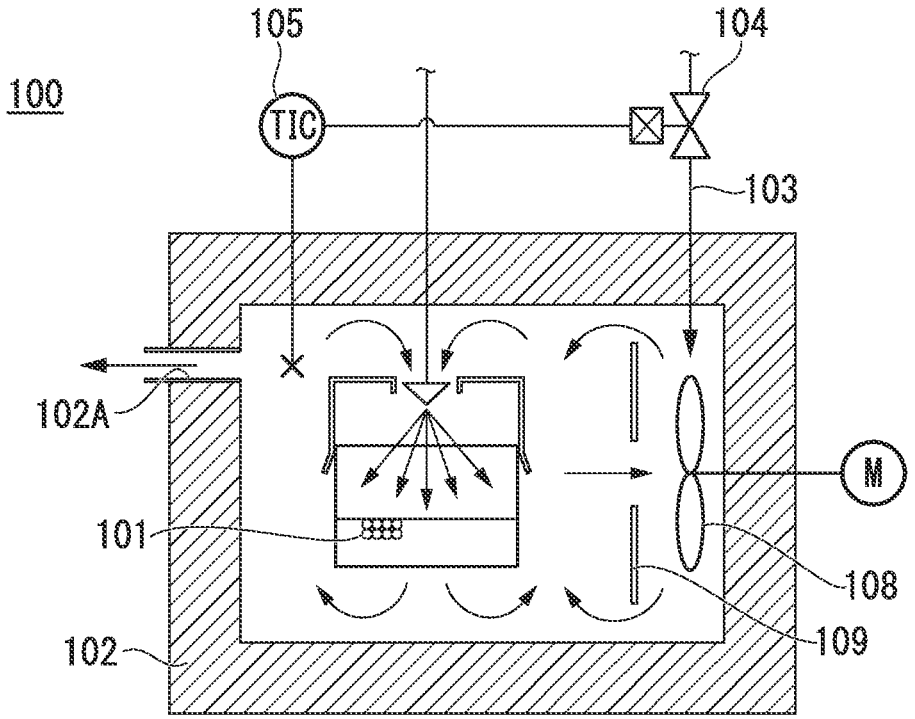
FIG. 12 is a cross-sectional view illustrating a schematic outline of a conventional sub-zero treatment device.

FIG. 11 is a cross-sectional view along the line N-N of the exhaust member, the third side wall of the cooling tank main body, and the second plate-like member of the baffle member illustrated in FIG. 9. In FIG. 11, structural portions that are the same as those in FIG. 9 and FIG. 10 are labeled with the same reference signs.

As illustrated in FIG. 9 to FIG. 11, the exhaust member insertion hole 76 is provided so as to penetrate through the second plate-like member 72-2 in a location opposing the through-hole 14. The exhaust member 31 is inserted through the exhaust member insertion hole 76.

As illustrated in FIG. 9, the third plate-like member 72-3 is disposed inside the cooling tank 13 near the fourth side wall 39-4, in an orientation parallel to the fourth side wall 39-4. One of the edges in the transverse direction of the third plate-like member 72-3 is integrated with the first plate-like member 72-1, and the other edge in the transverse direction contacts the inside surface of the first side wall 39-1.

The third plate-like member 72-3 has a second blowout port 74-2. The second blowout port 74-2 is provided so as to penetrate through the lower portion of the third plate-like member 72-3 in a location opposing the first blowout port 74-1.

The second blowout port 74-2 has the same shape as the first blowout port 74-1.

Furthermore, the second blowout port 74-2 has the same function as the first blowout port 74-1.

In the example shown in FIG. 9 and FIG. 10, the first and second blowout ports 74-1 and 74-2 are illustrated as through-slots that extend along the transverse direction of the plate-like members 72-2 and 72-3 respectively, but the shape of the first and second blowout ports 74-1 and 74-2 and the number of blowout ports are not limited to this particular example. Further, the shapes of the first and second blowout ports 74-1 and 74-2 may also be different from each other.

For example, a line or a plurality of lines of circular or rectangular through-hole portions may be provided in the plate-like members 72-2 and 72-3 as the first and second blowout ports 74-1 and 74-2, and the sizes of those through-hole portions may differ.

Alternatively, rectangular or oval-shaped through-slots may be positioned along either the transverse direction or the longitudinal direction of the plate-like members 72-2 and 72-3, and the sizes of those through-slots may differ.

The sub-zero treatment device 70 of the second embodiment, having the type of structure described above, is able to achieve similar effects to the sub-zero treatment device 10 of the first embodiment.

Although preferred embodiments of the invention have been described above in detail, the present invention is in no way limited by these specific embodiments, and various modifications and alterations can be made without departing from the scope of the present invention defined in the appended claims.

INDUSTRIAL APPLICABILITY

The present invention can be applied to a sub-zero treatment device that is capable of uniformly cooling a cooling target object and reducing the amount of liquid refrigerant used for cooling the cooling target object.

DESCRIPTION OF THE REFERENCE SIGNS

10, 65, 70: Sub-zero treatment device
13: Cooling tank
14: Through-hole
16: Temperature sensor
16A: Tip section
18: Temperature controller
21: Refrigerant supply line
23: Refrigerant supply portion
24: Liquid refrigerant inlet valve
25, 71: Baffle member
27: Agitation fan
28: Rotational axis
29: Rotational drive device
31: Exhaust member
35: Cooling tank main body
36: Lid
38: Base plate
38*a*: Upper surface
39-1: First side wall
39-2: Second side wall
39-3: Third side wall
39-4: Fourth side wall
43, 81: Cooling target object mounting chamber
45, 82: Fan housing chamber
47: Plate-like member
48: Suction port
49-1, 74-1: First blowout port
49-2, 74-2: Second blowout port
55: Exhaust member main body
55A: Center
56: Exhaust port
56A, 56B: Edge
57: Water drain hole
59: Exhaust port positioning space
72-1: First plate-like member
72-2: Second plate-like member
72-3: Third plate-like member
76: Exhaust member insertion hole
H: Height
θ: Central angle

The invention claimed is:

1. A sub-zero treatment device comprising:

a cooling tank composed of a cooling tank main body formed from a base plate and first to fourth side walls, and a lid, the cooling tank having a cooling target object mounting chamber in which a cooling target object is mounted, and a fan housing chamber that is connected to the cooling target object mounting chamber, a baffle member, disposed inside the cooling tank so as to separate the cooling target object mounting chamber and the fan housing chamber, and having a suction port for guiding an atmosphere of the cooling target object mounting chamber into the fan housing chamber, and blowout ports for guiding an atmosphere of the fan housing chamber into the cooling target object mounting chamber, an agitation fan housed in the fan housing chamber in a position opposing the suction port, the agitation fan converting a liquid refrigerant supplied to the fan housing chamber into a mist or a low-temperature gas, as well as agitating an atmosphere inside the cooling tank, and an exhaust member, extending from a through-hole provided in the cooling tank main body through to an interior of the cooling target object mounting chamber, and having an exhaust port, wherein the first to fourth side walls are disposed so as to surround an outer peripheral edge of the base plate and contact the lid, thereby forming an internal space inside the cooling tank, the exhaust port is disposed in an exhaust port positioning space located in the cooling target object mounting chamber within the internal space, such that if an orthogonal height between a surface of the base plate on a side of the internal space and a surface of the lid on a side of the internal space is deemed H, then the exhaust port positioning space is a space composed of a portion reaching an orthogonal distance of H/2 from the surface of the lid on the side of the internal space, and a transverse width of the exhaust port positioning space, which is a width in a direction orthogonal to said height and parallel to the baffle member having the suction port, is equal to a maximum value for a transverse width of the suction port in a direction orthogonal to said height and parallel to the baffle member having the suction port, with a center of the transverse width of the exhaust port positioning space coinciding with a center of the transverse width of the suction port.

2. The sub-zero treatment device according to claim 1, wherein the exhaust port is disposed in the exhaust port positioning space located between the cooling target object and the baffle member.

3. The sub-zero treatment device disclosed in claim 1, wherein the exhaust member has an exhaust member main body, and the exhaust member main body is positioned so that the exhaust port faces toward the lid.

4. The sub-zero treatment device according to claim 3, wherein the exhaust member main body is a circular cylindrically shaped pipe, and when the exhaust member is cut along a surface that passes through the exhaust port in a direction orthogonal to a direction of extension of the exhaust member main body, the exhaust port has a central angle, formed by connecting both edges of the exhaust port with a center of the exhaust member main body, that is not more than 90°.

5. The sub-zero treatment device according to claim 1, wherein the exhaust member has a water drain hole that is formed facing toward the base plate.

6. The sub-zero treatment device according to claim 1, wherein the baffle member has at least one plate-like member, the plate-like member having a uniform thickness, and the suction port and the blowout ports penetrate through the same plate-like member.

7. The sub-zero treatment device according to claim 1, wherein the baffle member has a first plate-like member that faces the agitation fan, and second and third plate-like members disposed orthogonally relative to the first plate-like member, and the suction port penetrates through the first plate-like member, and the blowout ports penetrate through the second and third plate-like members.

* * * * *